US008231411B1

(12) United States Patent
Westman et al.

(10) Patent No.: US 8,231,411 B1
(45) Date of Patent: Jul. 31, 2012

(54) CARD EDGE CONNECTOR

(75) Inventors: John Eugene Westman, Harrisburg, PA (US); Brian Keith McMaster, Jr., Mechanicsburg, PA (US); Edmund Luther Jacobs, Harrisburg, PA (US); Edward Eugene Knisely, Jr., Middletown, PA (US); Alan Anthony Kordas, Lewisberry, PA (US); Craig William Clewell, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/038,223

(22) Filed: Mar. 1, 2011

(51) Int. Cl.
*H01R 13/648* (2006.01)

(52) U.S. Cl. ..... 439/607.05; 439/108

(58) Field of Classification Search ..... 439/607.05, 439/607.13, 607.14, 108
See application file for complete search history.

(56) References Cited

U.S. PATENT DOCUMENTS 5,919,049 A * 7/1999 Petersen et al. ..... 439/60
6,015,299 A * 1/2000 Walse et al. ..... 439/60
6,095,821 A * 8/2000 Panella et al. ..... 439/60
6,129,555 A * 10/2000 Daikuhara et al. ..... 439/60
6,309,254 B1 * 10/2001 Korsunsky ..... 439/637
635,013 A1 2/2002 Fogg et al.
6,394,823 B1 * 5/2002 Dunham et al. ..... 439/108
6,464,537 B1 * 10/2002 Letourneau et al. ..... 439/607.14
654,055 A1 4/2003 Kemmick et al.
6,561,850 B2 * 5/2003 Letourneau et al. ..... 439/607.08
680,558 A1 10/2004 Akama et al.
741,039 A1 8/2008 Szczesny et al.
767,413 A1 3/2010 Fogg et al.

* cited by examiner

*Primary Examiner* — Gary F. Paumen

(57) ABSTRACT

A card edge connector is provided for mating with a printed circuit board (PCB) having a card edge. The connector includes a housing having an elongate card slot and a mounting side. The card slot extends a slot length and is configured to receive the card edge of the PCB therein. The mounting side extends a side length and a width. The side length of the mounting side extends in a direction that extends along a direction of the slot length of the card slot. Signal contacts are held by the housing. The signal contacts include first signal contacts and second signal contacts. The first and second signal contacts have respective first and second signal mounting segments that are arranged in first and second signal rows, respectively, that extend along the side length of the mounting side of the housing. The first and second signal rows are spaced apart from each other along the width of the mounting side. Ground contacts are held by the housing. The ground contacts include ground mounting segments arranged in a ground row that extends along the side length of the mounting side. The ground row extends between the first and second signal rows along the width of the mounting side of the housing.

20 Claims, 11 Drawing Sheets

CARD EDGE CONNECTOR

BACKGROUND OF THE INVENTION

The subject matter described and/or illustrated herein relates generally to card edge connectors.

Computers and servers use numerous types of electronic modules, such as processor and memory modules (e.g. Dynamic Random Access Memory (DRAM), Synchronous Dynamic Random Access Memory (SDRAM), or Extended Data Out Random Access Memory (EDO RAM), and the like). The memory modules are produced in a number of formats such as, for example, Single In-line Memory Modules (SIMM's), Dual In-line Memory Modules (DIMM's), Small Outline DIMM's (SODIMM's), Fully Buffered DIMM's, and the like. The electronic modules may be installed in card edge connectors that are mounted on a motherboard or other system board.

Electronic modules often include a printed circuit board (PCB) having a card edge that is received within a card slot of the card edge connector. The PCB includes contact pads arranged along the card edge on two opposite sides of the PCB. The card edge connector includes a pair of opposite rows of electrical contacts extending within the card slot. When the card edge of the PCB is received within the card slot, the electrical contacts of each row of the card edge connector engage the contact pads on a corresponding one of the sides of the PCB. The electrical contacts and the contact pads are typically arranged in differential signal pairs. Ground contacts and ground contact pads are sometimes positioned between adjacent differential pairs within the rows of electrical contacts and contact pads, respectively. The ground contacts and contact pads facilitate decreasing crosstalk between adjacent differential signal pairs. But, the proximity of the ground contacts and ground contact pads to the differential pairs may reduce the impedance of signals transmitted through the differential pairs, which may reduce the efficiency of data transfer through the card edge connector.

BRIEF DESCRIPTION OF THE INVENTION

In one embodiment, a card edge connector is provided for mating with a printed circuit board (PCB) having a card edge. The connector includes a housing having an elongate card slot and a mounting side. The card slot extends a slot length and is configured to receive the card edge of the PCB therein. The mounting side extends a side length and a width. The side length of the mounting side extends in a direction that extends along a direction of the slot length of the card slot. Signal contacts are held by the housing. The signal contacts include first signal contacts and second signal contacts. The first and second signal contacts have respective first and second signal mounting segments that are arranged in first and second signal rows, respectively, that extend along the side length of the mounting side of the housing. The first and second signal rows are spaced apart from each other along the width of the mounting side. Ground contacts are held by the housing. The ground contacts include ground mounting segments arranged in a ground row that extends along the side length of the mounting side. The ground row extends between the first and second signal rows along the width of the mounting side of the housing.

In another embodiment, an electrical connector assembly includes a printed circuit board (PCB) having a card edge, and a card edge connector. The card edge connector includes a housing having an elongate card slot and a mounting side. The card slot extends a slot length and receives the card edge of the PCB therein. The mounting side extends a side length and a width. The side length of the mounting side extends in a direction that extends along a direction of the slot length of the card slot. Signal contacts are held by the housing. The signal contacts include first signal contacts and second signal contacts. The first and second signal contacts have respective first and second signal mounting segments that are arranged in first and second signal rows, respectively, that extend along the side length of the mounting side of the housing. The first and second signal rows are spaced apart from each other along the width of the mounting side. Ground contacts are held by the housing. The ground contacts include ground mounting segments arranged in a ground row that extends along the side length of the mounting side. The ground row extends between the first and second signal rows along the width of the mounting side of the housing.

DETAILED DESCRIPTION OF THE INVENTION

Figure 1:
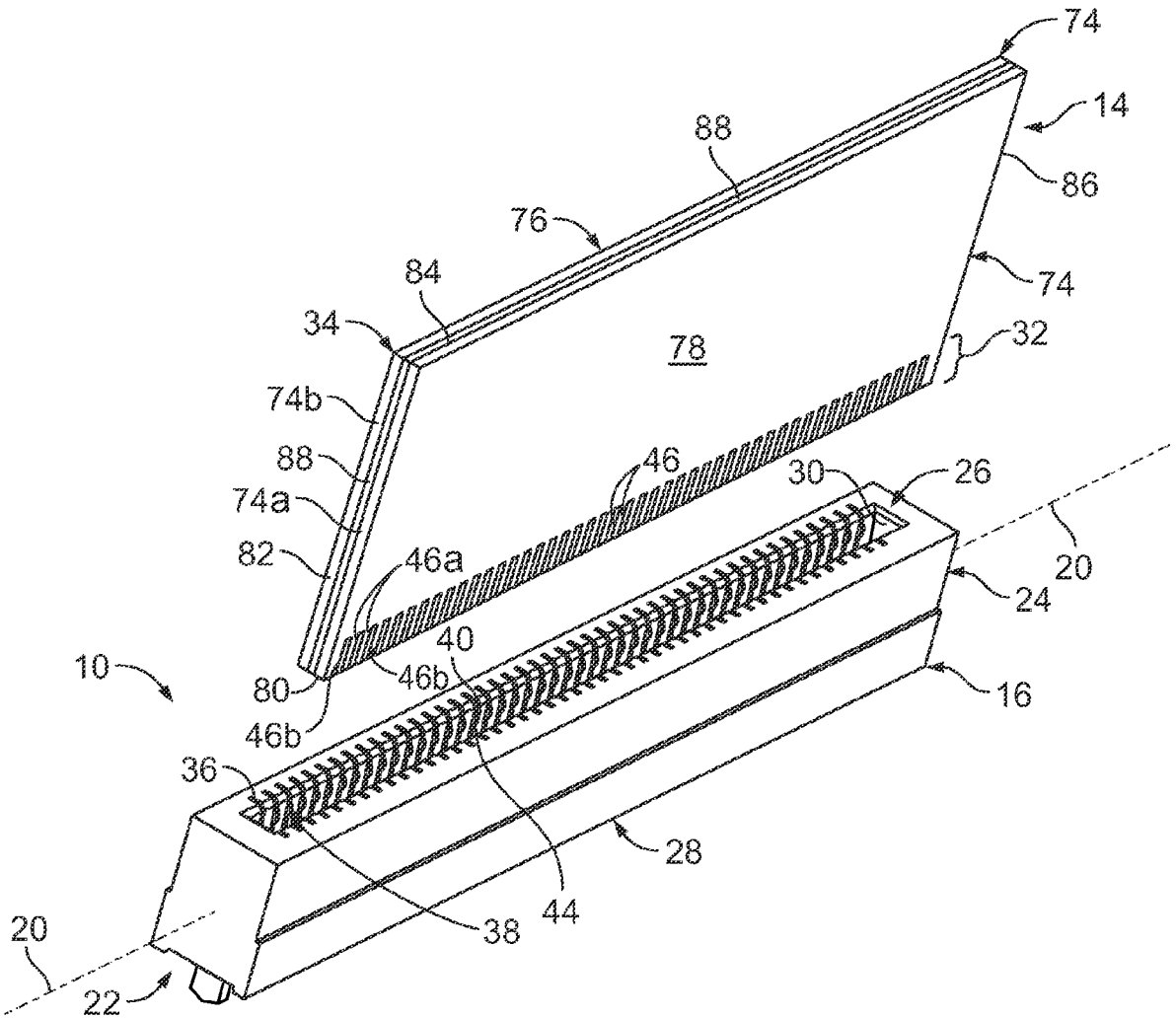
FIG. 1 is a partially exploded perspective view of an exemplary embodiment of a card edge connector and a portion of an exemplary embodiment of an electronic module.

FIG. 1 is a partially exploded perspective view of an exemplary embodiment of a card edge connector 10 and a portion of an exemplary embodiment of an electronic module 14. The connector 10 includes a dielectric housing 16 that extends a length along a central longitudinal axis 20 from an end 22 to an opposite end 24. The housing 16 has a mating side 26 and a mounting side 28. The housing 16 includes a card slot 30 that is configured to receive a card edge 32 of the electronic module 14 therein. More specifically, the electronic module 14 includes a printed circuit board (PCB) 34 that includes the card edge 32. Only the PCB 34 of the electronic module 14 is shown in FIG. 1. As used herein, the term "printed circuit board" is intended to mean any electric circuit in which the electrical conductors have been printed or otherwise deposited in predetermined patterns on an electrically insulating substrate. A combination of the connector 10 and the electronic module 14 may be referred to herein as an "electrical connector assembly".

Figure 3:
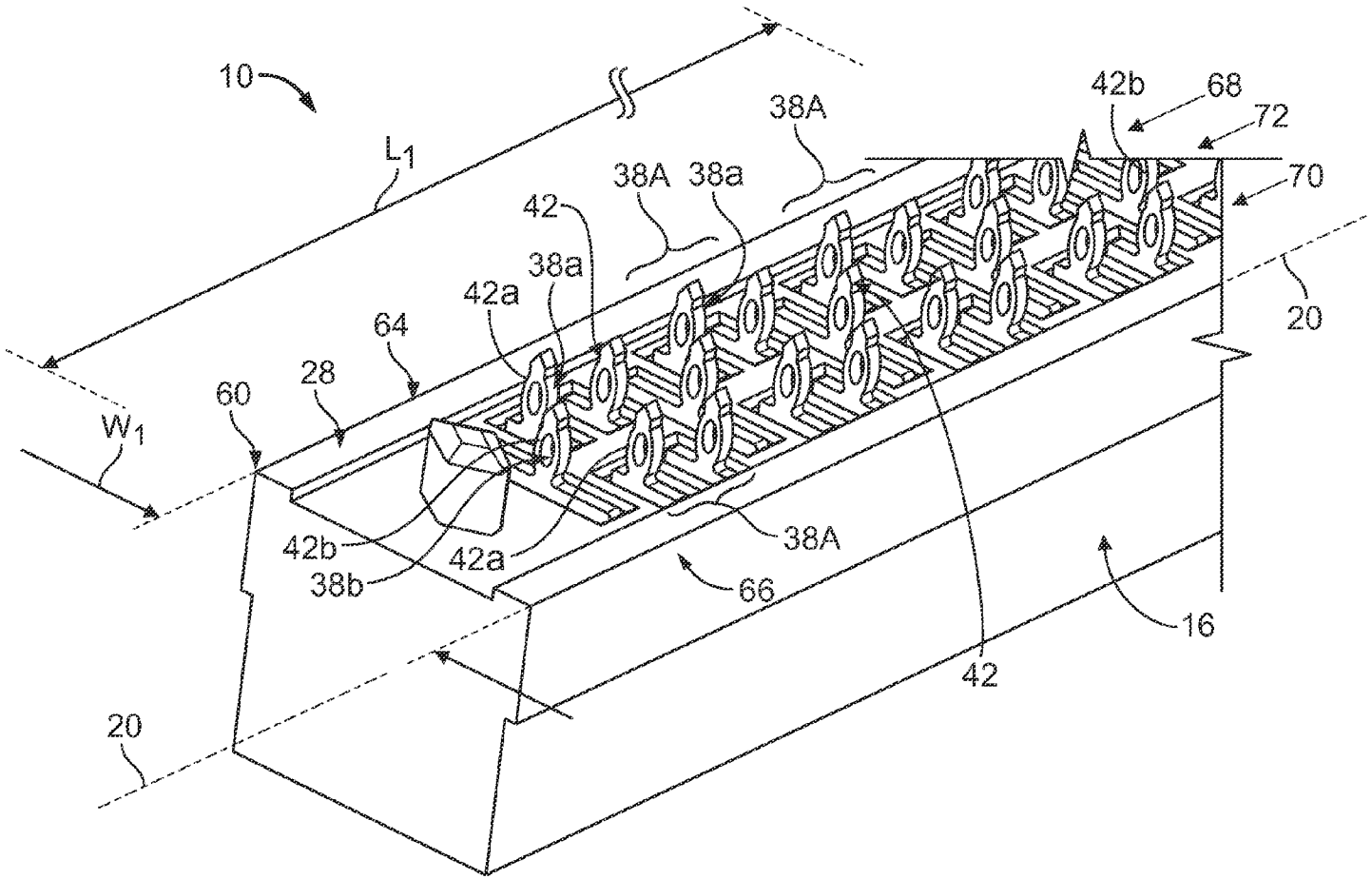
FIG. 3 is a perspective view of a portion of the card edge connector shown in FIG. 1.

The housing 16 includes a plurality of openings 36 that each fluidly communicate with the card slot 30 and extend through the housing 16 from the mating side 26 to the mounting side 28. Each opening 36 holds at least a portion of one or more electrical contacts 38 therein. The electrical contacts 38 include mating segments 40 and mounting segments 42 (FIG. 3). The mating segments 40 extend into the card slot 30 and include mating interfaces 44 that engage corresponding contact pads 46 on the card edge 32 of the electronic module 14 when the electronic module 14 is mated with the connector 10. The mounting segments 42 extend along the mounting side 28 of the housing 16 and are configured to electrically connect the connector 10 to a motherboard (not shown). When the electronic module 14 is mated with the connector 10, the connector 10 electrically connects the electronic module 14 to the motherboard. The connector 10 may include any number of the electrical contacts 38.

Figure 2:
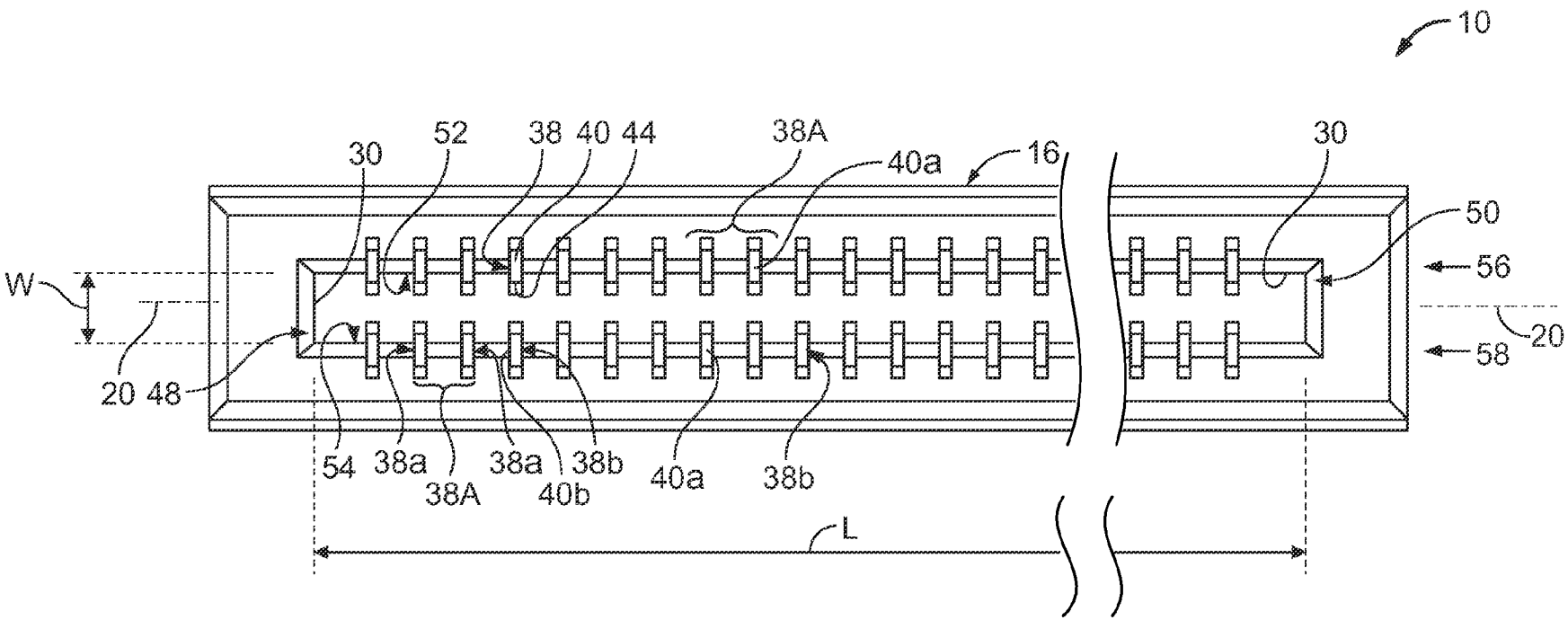
FIG. 2 is a top plan view of the card edge connector shown in FIG. 1.

FIG. 2 is a top plan view of the card edge connector 10. The card slot 30 extends a length L along the central longitudinal axis 20 from an end 48 to an opposite end 50. The card slot 30 extends a width W from a side 52 to an opposite side 54. The card slot 30 is elongate such that the length L of the card slot 30 is greater than the width W of the card slot 30. The mating segments 40 of the electrical contacts 38 are arranged in a pair of opposing rows 56 and 58 that extend along the sides 52 and 54, respectively, of the card slot 30. In other words, each of the rows 56 and 58 extends along the length L of the card slot 30 on a respective one of the sides 52 and 54. More particularly, the rows 56 and 58 extend in directions that extend along the direction of the length L of the card slot 30. The mating interfaces 44 of the electrical contacts 38 within the row 56 face generally towards, or oppose, the mating interfaces 44 of the electrical contacts 38 within the opposing row 58, and vice versa. The length L of the card slot 30 may be referred to herein as a "slot length". Each of the sides 52 and 54 of the card slot 30 may be referred to herein as a "first side" and/or a "second side". The rows 56 and 58 may each be referred to herein as a "first row" and/or a "second row".

The electrical contacts 38 include signal contacts 38*a* and ground contacts 38*b*. Optionally, the electrical contacts 38 include one or more power contacts that are configured to carry electrical power. The signal contacts 38*a* are arranged in differential signal pairs 38A. In the exemplary embodiment, mating segments 40*a* of adjacent signal contacts 38*a* within the row 56 are arranged in differential signal pairs 38A, and mating segments 40*a* of adjacent signal contacts 38*a* within the row 58 are arranged in differential signal pairs 38A. In some alternative embodiments, one or more of the signal contacts 38*a* is not arranged in a differential signal pair. Moreover, in some alternative embodiments, the mating segment 40*a* of a signal contact 38*a* within the row 56 is arranged in a differential signal pair with the mating segment 40*a* of a signal contact 38*a* within the row 58. In the exemplary embodiment, along the length of the housing 16 (i.e., along the central longitudinal axis 20), the mating segments 40*a* of the differential signal pairs 38A within the row 56 are aligned with the mating segments 40*a* of corresponding differential signal pairs 38A within the row 58. Alternatively, the mating segments 40*a* of differential pairs 38A within the rows 56 and 58 are alternatively staggered relative to each other along the length of the housing 16 (e.g., the mating segments 140*a* of the differential pairs 138A of the card edge connector 110 shown in FIGS. 7-9).

Each of the mating segments 40*a* of the signal contacts 38*a* may be referred to herein as a "signal mating segment". The signal contacts 38*a* having mating segments 40*a* arranged within the row 56 may be referred to herein as "first signal contacts" and/or "second signal contacts", while the signal contacts 38*a* having mating segments 40*a* arranged within the row 58 may be referred to herein as "first signal contacts" and/or "second signal contacts". The differential signal pairs 38A of the signal contacts 38*a* within the row 56 and the differential signal pairs 38A of the signal contacts 38*a* within the row 58 may be referred to herein as "first differential signal pairs" and/or "second differential signal pairs".

Mating segments 40*b* of the ground contacts 38*b* are arranged within the rows 56 and 58 between adjacent differential signal pairs 38A. In the exemplary embodiment, a single mating segment 40*b* of the ground contacts 38*b* extends between each pair of adjacent differential signal pairs 38A within each of the rows 56 and 58. But, any number of mating segments 40*b* of the ground contacts 38*b* may extend between adjacent differential signal pairs 38A. Each of the mating segments 40*b* of the ground contacts 38*b* may be referred to herein as a "ground mating segment".

FIG. 3 is a perspective view of a portion of the card edge connector 10 illustrating the mounting side 28 of the housing 16. The mounting side 28 extends a length $L_1$ along the central longitudinal axis 20 from an end 60 to an opposite end (not shown). Only a portion of the length $L_1$ of the mounting side 28 is shown in FIG. 3. The mounting side 28 extends a width $W_1$ from a side 64 to an opposite side 66. The length $L_1$ of the mounting side 28 extends in a direction that extends along the direction of the length L of the card slot 30. For example, in the exemplary embodiment the length $L_1$ of the mounting side 28 extends in a direction that is approximately parallel to the direction of the length L of the card slot 30. The length $L_1$ of the mounting side 28 may be referred to herein as a "side length".

Mounting segments 42*a* of the signal contacts 38*a* are arranged in a pair of rows 68 and 70 that extend along the length $L_1$ of the mounting side 28. More particularly, the rows 68 and 70 extend in directions that extend along the direction of the length $L_1$ of the mounting side 28. The rows 68 and 70 are spaced apart from each other along the width $W_1$ of the mounting side 28. As described above, the signal contacts 38*a* are arranged in the differential signal pairs 38A. Specifically, the mounting segments 42*a* of adjacent signal contacts 38*a* within the row 68 are arranged in the differential signal pairs 38A, and the mounting segments 42*a* of adjacent signal contacts 38*a* within the row 70 are arranged in the differential signal pairs 38A. In some alternative embodiments, the mounting segment 42*a* of a signal contact 38*a* within the row 68 is arranged in a differential signal pair with the mounting segment 42*a* of a signal contact 38*a* within the row 70. In the exemplary embodiment, the mounting segments 42*a* of differential pairs 38A within the rows 68 and 70 are transversely aligned with each other along the length $L_1$ of the mounting side 28 (i.e., along the central longitudinal axis 20). Alternatively, the mounting segments 42*a* of differential pairs 38A within the rows 68 and 70 are staggered with respect to each other along the length $L_1$ of the mounting side 28 (e.g., the mounting segments 142*a* of the differential pairs 138A of the card edge connector 110 shown in FIGS. 7-9). The mounting segments 42*a* arranged within the row 68 may be referred to herein as "first signal mounting segments" and/or "second signal mounting segments", while the mounting segments 42*a* arranged within the row 70 may be referred to herein as "first signal mounting segments" and/or "second signal mounting segments". The rows 68 and 70 may each be referred to herein as a "first signal row" and/or a "second signal row".

Mounting segments 42*b* of the ground contacts 38*b* are arranged in a row 72 that extends along the length $L_1$ of the of the mounting side 28 of the housing 16. More particularly, the row 72 extends in a direction that extends along the direction of the length $L_1$ of the of the mounting side 28. The row 72 extends between the rows 68 and 70 along the width $W_1$ of the mounting side 28 of the housing 16. Along the length $L_1$ of the mounting side 28, the mounting segments 42*b* of the ground contacts 38*b* extend between adjacent differential signal pairs 38A within the row 68 and between adjacent differential pairs 38A within the row 70. Although only a single mounting segment 42*b* of the ground contacts 38*b* extends between adjacent differential signal pairs 38A within each of the rows 68 and 70 along the length $L_1$ of the mounting side 28, any number of mounting segments 42*b* of the ground contacts 38*b* may extend between adjacent differential signal pairs 38A within each of the rows 68 and 70 along the length $L_1$ of the mounting side 28. Each of the mounting segments 42*b* of the ground contacts 38*b* may be referred to herein as a "ground mounting segment", while the row 72 may be referred to herein as a "ground row".

Referring again to FIG. 1, the PCB 34 of the electronic module 14 includes a substrate 74. The substrate 74 includes a pair of opposite sides 76 and 78. The PCB 34 includes edge surfaces 80, 82, 84, and 86, which intersect the sides 76 and 78. The card edge 32 of the PCB 34 is defined by the edge surface 80, portions of the sides 76 and 78 that are proximate the edge surface 80, and portions of the edge surfaces 82 and 84 that are proximate the edge surface 80. As described above, the PCB 34 includes contact pads 46 arranged along the card edge 32. Specifically, on each of the sides 76 and 78 of the substrate 74, the card edge 32 includes a plurality of signal contact pads 46*a* and a plurality of ground contact pads 46*b*. Electrical traces (not shown) and/or other electrical conductors (not shown) electrically connect each of the signal contact pads 46*a* to one or more electronic components (not shown) of the electronic module 14. Similarly, electrical traces (not shown) and/or other electrical conductors (not shown) electrically connect each of the ground contact pads 46*b* to one or more grounds of the electronic module 14. For example, in the exemplary embodiment the PCB 34 includes a ground plane 88 and the electrical traces and/or other electrical conductors electrically connect the ground contact pads 46*b* to the ground plane 88. The PCB 34 may include any number of the contact pads 46. Each of the ground contact pads 46*b* on the side 76 and each of the ground contact pads 46*b* on the side 78 may be referred to herein as a "first ground contact pad" and a "second ground contact pad". Each of the sides 76 and 78 of the substrate 74 may be referred to herein as a "first side" and/or a "second side" of the card edge 32.

As can be seen in FIG. 1, the ground plane 88 extends along the card edge 32 of the PCB 34. The ground plane 88 is a layer of the PCB 34 that appears as an infinite ground potential to at least some of the signals being transmitted by the signal contacts 38*a*. In the exemplary embodiment, the ground plane 88 is an internal layer of the PCB 34. In other words, the ground plane optionally extends within the substrate 74 of the PCB 34 at a location between the sides 76 and 78 and thereby within a thickness of the substrate 74 that is defined from the side 76 to the side 78. In the exemplary embodiment, the ground plane 88 is an internal layer of the PCB 34 that divides the substrate 74 into two layers 74*a* and 74*b*. The ground plane 88 is sandwiched between the layers 74*a* and 74*b* of the substrate 74. Alternatively, the ground plane 88 is an exterior layer of the PCB 34 that extends on the side 76 and/or the side 78 of the substrate 74.

The ground plane 88 optionally extends to the edge surfaces 80, 82, 84, and/or 86, such that the ground plane 88 defines a portion of the edge surfaces 80, 82, 84, and/or 86 (the remainder being defined by the substrate 74). In the exemplary embodiment, the ground plane 88 extends to each of the edge surfaces 80, 82, 84, and 86 and extends continuously therebetween. The ground plane 88 thereby extends continuously between the substrate layers 74*a* and 74*b* from the edge surface 80 to the edge surface 84 and from the edge surface 82 to the edge surface 86. Alternatively, the ground plane 88 does not extend continuously from the edge surface 80 to the edge surface 84 and from the edge surface 82 to the edge surface 86.

The ground plane 88 extends along a larger area of the PCB 34 than each of the contact pads 46 and each of any electrical traces of the PCB 34. The contact pads 46 and any electrical traces of the PCB 34 are not ground planes. In some alternative embodiments, the PCB 34 includes more than one ground plane 88, wherein some or all of the ground planes 88 may or may not be electrically connected together. The PCB 34 may include any number of the ground planes 88, wherein each ground plane 88 may be an interior and/or exterior layer of the PCB 34.

Figure 4:
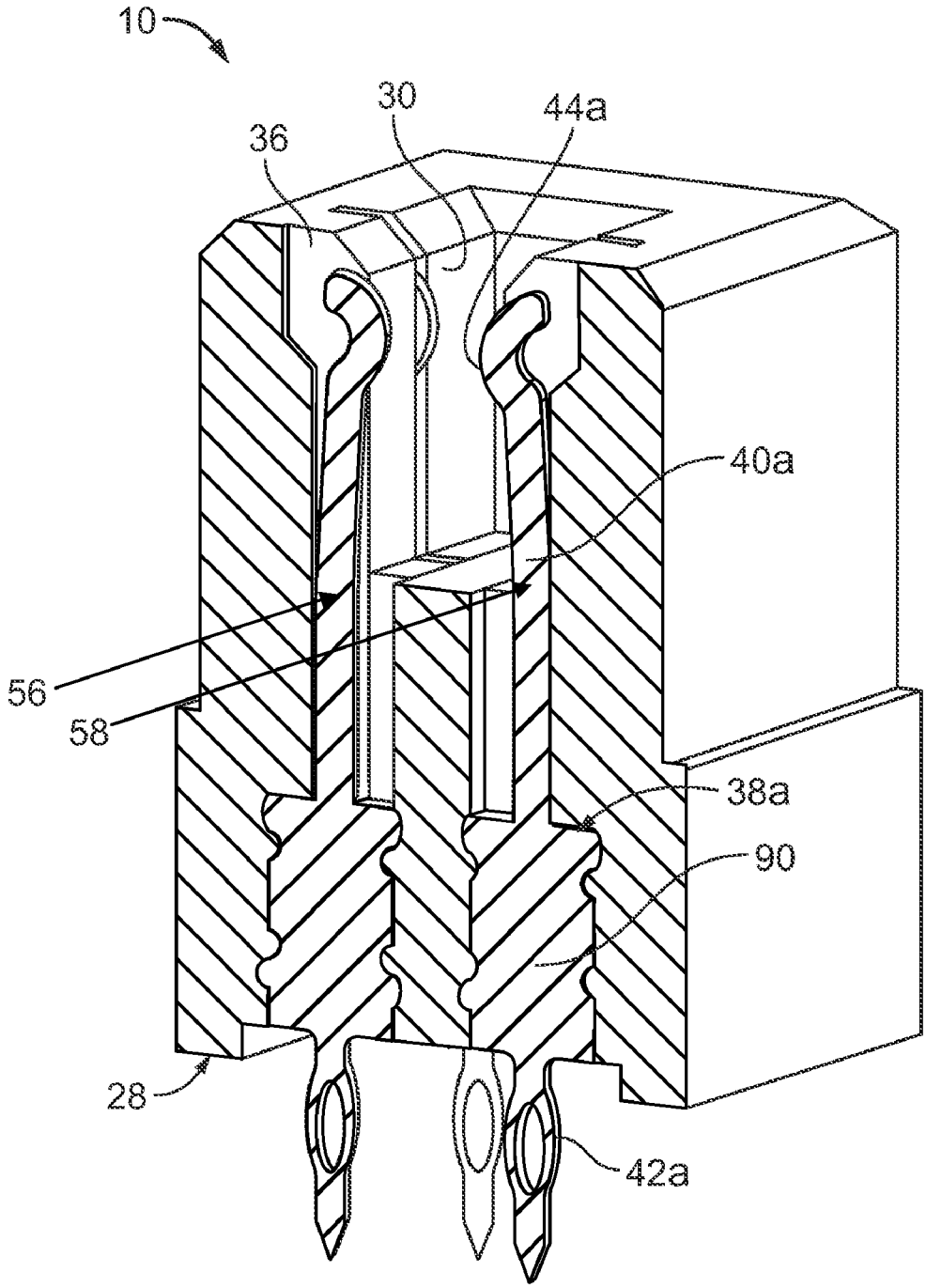
FIG. 4 is a perspective view of a cross section of the card edge connector shown in FIG. 1 illustrating an exemplary embodiment of a signal contact of the card edge connector.
Figure 6:
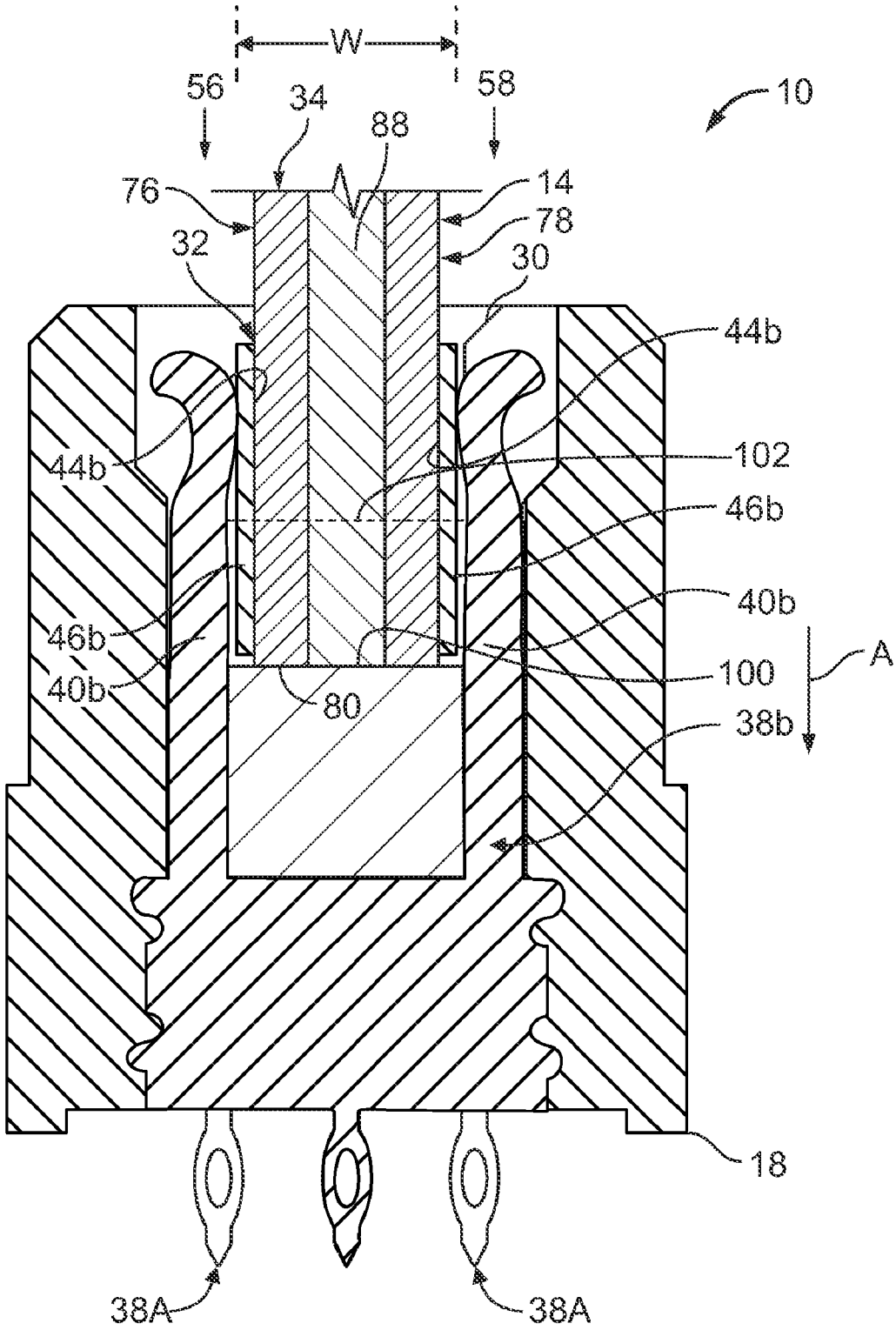
FIG. 6 is a cross-sectional view of the card edge connector shown in FIG. 1 illustrating the electronic module shown in FIG. 1 mated therewith.

FIG. 4 is a perspective view of a cross section of the card edge connector 10 illustrating an exemplary embodiment of a signal contact 38*a*. The signal contacts 38*a* include the mating segments 40*a*, the mounting segments 42*a*, and bases 90 that extend from the mating segments 40*a* to the mounting segments 42*a*. The signal contacts 38*a* are held by the housing 16 within the corresponding opening 36 such that the mating segments 40*a* extend into the card slot 30. More specifically, mating interfaces 44*a* of the mating segments 40*a* extend into the card slot 30. The mating interfaces 44*a* of the mating segments 40*a* that are arranged in the row 56 engage corresponding contact pads 46*a* (FIG. 1) on the side 76 (FIGS. 1 and 6) of the PCB 34 (FIGS. 1 and 6) of the electronic module 14 (FIGS. 1 and 6). The mating interfaces 44*a* of the mating segments 40*a* that are arranged in the row 58 engage corresponding contact pads 46 on the side 78 (FIGS. 1 and 6) of the PCB 34. The mating segments 40*a* of the signal contacts 38*a* are springs that have a natural resting position shown in FIG. 4. The mating segments 40*a* resiliently deflect, against bias to the natural resting position, when engaged by the contact pads 46 of the electronic module 14. The bases 90 may be referred to herein as "signal bases".

The mounting segments 42*a* of the signal contacts 38*a* extend along the mounting side 28 of the housing 16 for electrical connection to the motherboard. In the exemplary embodiment, the mounting segments 42*a* include eye-of-the needle press-fit pins that are received within corresponding electrical vias (not shown) of the mother board. But, the mounting segment 42*a* of each signal contact 38*a* may have any other structure, geometry, and/or the like that enables the mounting segment 42*a* to electrically connect to the motherboard, such as, but not limited to, a solder tail, a surface mount structure, another type of press-fit pin, and/or the like.

Figure 5:
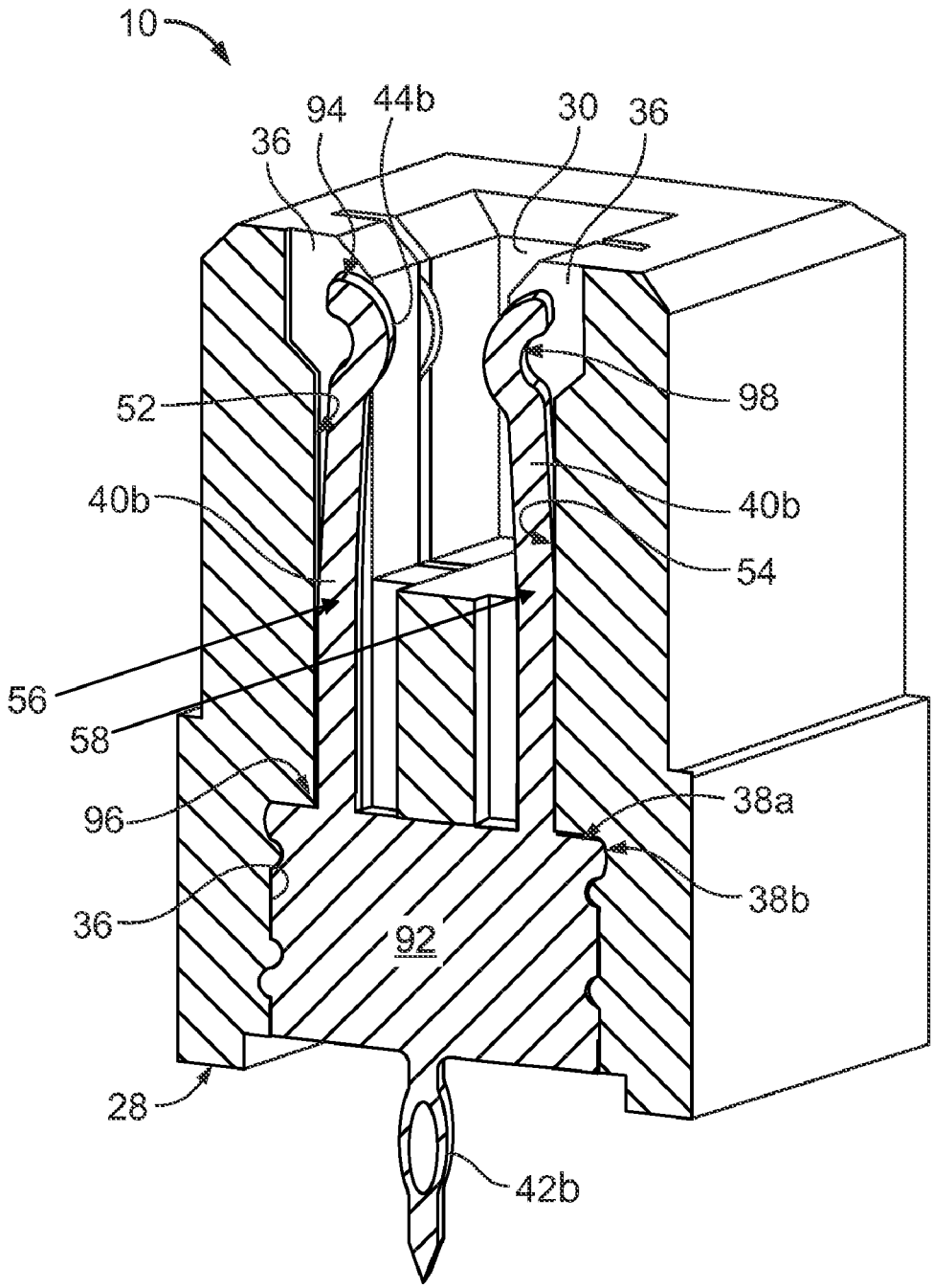
FIG. 5 is a perspective view of another cross section of the card edge connector shown in FIG. 1 illustrating an exemplary embodiment of a ground contact of the card edge connector.

FIG. 5 is a perspective view of another cross section of the card edge connector 10 illustrating an exemplary embodiment of a ground contact 38*b*. The ground contact 38*b* is held by the housing 16 within the corresponding opening 36. The ground contact 38*b* includes a base 92, one of the mounting segments 42*b*, and two of the mating segments 40*b*. The mating segments 40*b* extend outwardly from the base 92 such that the mating segments 40*b*, and more particularly the mating interfaces 44*b* thereof, extend into the card slot 30. As can be seen in FIG. 5, one of the mating segments 40*b* of the ground contact 38*b* is arranged within the row 56, while the other mating segment 40*b* of the ground contact 38*b* is arranged within the row 58. The mating interfaces 44*b* of the two mating segments 40*b* of the ground contact 38*b* oppose each other within the card slot 30 such that the two mating interfaces 44*b* are configured to engage the card edge 32 (FIGS. 1 and 6) of the PCB 34 (FIGS. 1 and 6) therebetween. The mating interface 44*b* of the mating segment 40*b* arranged in the row 56 engages a corresponding contact pad 46*b* (FIGS. 1 and 6) on the side 76 (FIGS. 1 and 6) of the PCB 34 (FIGS. 1 and 6) of the electronic module 14 (FIGS. 1 and 6). The mating interface 44*b* of the mating segment 40*b* that is arranged in the row 58 engages a corresponding contact pad 46 on the side 78 (FIGS. 1 and 6) of the PCB 34. Each of the mating segments 40*b* of the ground contact 38*b* may be referred to herein as a "first ground mating segment" and/or a "second ground mating segment". The base 92 may be referred to herein as a "ground base".

In the exemplary embodiment, the mating segments 40*b* of the ground contact 38*b* are elongate arms that extend a length from the base 92 to a tip end 94. Specifically, the mating segments 40*b* extend the length from the tip end 94 to a base end 96 that extends from the base 92. Optionally, the mating segments 40*b* include curved sub-segments 98. Each curved sub-segment 98 includes the corresponding mating interface 44*b*. For each mating segment 40*b* that is arranged within the row 56 (along the side 76 of the card slot), the curved sub-segment 98 offsets the mating interface 44*b*, relative to the base end 96, toward the side 54 of the card slot 30. For each mating segment 40*b* that is arranged within the row 58 (along the side 78 of the card slot), the curved sub-segment 98 offsets the mating interface 44*b*, relative to the base end 96, toward the side 52 of the card slot 30. The elongate arms of the mating segments 40*b* of the ground contacts 38*b* are springs that have a natural resting position shown in FIG. 5. The mating segments 40*b* resiliently deflect, against bias to the natural resting position, when engaged by the contact pads 46 of the electronic module 14.

The mounting segment 42*b* of each ground contact 38*b* extends along the mounting side 28 of the housing 16 for electrical connection to the motherboard. The exemplary embodiment of the mounting segments 42*b* is an eye-of-the needle press-fit pin that is received within a corresponding electrical via (not shown) of the mother board. But, the mounting segment 42*b* of one or more of the ground contacts 38*b* may have any other structure, geometry, and/or the like that enables the mounting segment 42*b* to electrically connect to the motherboard, such as, but not limited to, a solder tail, a surface mount structure, another type of press-fit pin, and/or the like.

FIG. 6 is a cross-sectional view of the card edge connector 10 illustrating the electronic module 14 mated therewith. When the electronic module 14 is mated with the connector 10, the card edge 32 of the PCB 34 of the electronic module 14 is received within the card slot 30 of the connector 10. The mating segments 40*b* of the ground contacts 38*b* engage the card edge 32 of the PCB 34 therebetween such that the ground contacts 38*b* are electrically connected to the ground plane 88. More specifically, the mating interfaces 44*b* of the mating segments 40*b* arranged within the row 56 are engaged with the ground contact pads 46*b* on the side 76 of the card edge 32 to electrically connect the mating segments 40*b* to the ground contact pads 46*b*, and thereby the ground plane 88. The mating interfaces 44*b* of the mating segments 40*b* arranged within the row 58 are engaged with the ground contact pads 46*b* on the side 78 of the card edge 32 to electrically connect the mating segments 40*b* to the ground contact pads 46*b*, and thereby the ground plane 88. Optionally, the edge surface 80 of the PCB 34 abuts a shoulder 100 of the housing 16 when the electronic module 14 is mated with the connector 10.

As can be seen in FIG. 6, the ground plane 88 of the PCB 34 extends between the mating segments 40*b* of the ground contact 38*b* when the card edge 32 is received within the card slot 30. Accordingly, when the electronic module 14 is mated with the connector 10, the ground plane 88 extends between the opposing rows 56 and 58 of the mating segments 40 of the electrical contacts 38. For example, the ground plane 88 intersects a straight line 102 drawn from a mating segment 40 within the row 56 to a mating segment 40 within the row 58. Along the width W of the card slot 30, the ground plane 88 extends between the differential signal pairs 38A that are arranged within the row 56 and the differential signal pairs 38A that are arranged within the row 58. The ground plane 88 thus electrically isolates the differential signal pairs 38A within the row 56 from the differential signal pairs 38A within the row 58. As can be seen in FIG. 6, the bases 92 of the ground contacts 38*b* extend across the width W of the card slot 30 from the side 52 (FIG. 2) to the side 54 (FIG. 2). The bases 92 act as continuations of the ground plane 88 that continue the ground plane 88 in the direction of the arrow A in FIG. 6. The bases 92 and the mating segments 40*b* of the ground contacts 38*b* electrically isolate adjacent differential signal pairs 38A within the row 56 from each other and electrically isolate adjacent differential signal pairs 38A within the row 58 from each other. The impedance of the connector 10 can be tuned to facilitate achieving a predetermined impedance by selecting the pitch between adjacent signal contacts 38*a* and/or between adjacent differential signal pairs 38A, by selecting the number and/or spacing of the ground contacts 38*b* relative to each other and/or signal contacts 38*a*, by selecting the amount of air and/or dielectric materials of the housing 16 that extend between signal contacts 38*a* and/or between a signal contact 38*a* and a ground contact 38*b*, and/or the like.

Figure 7:
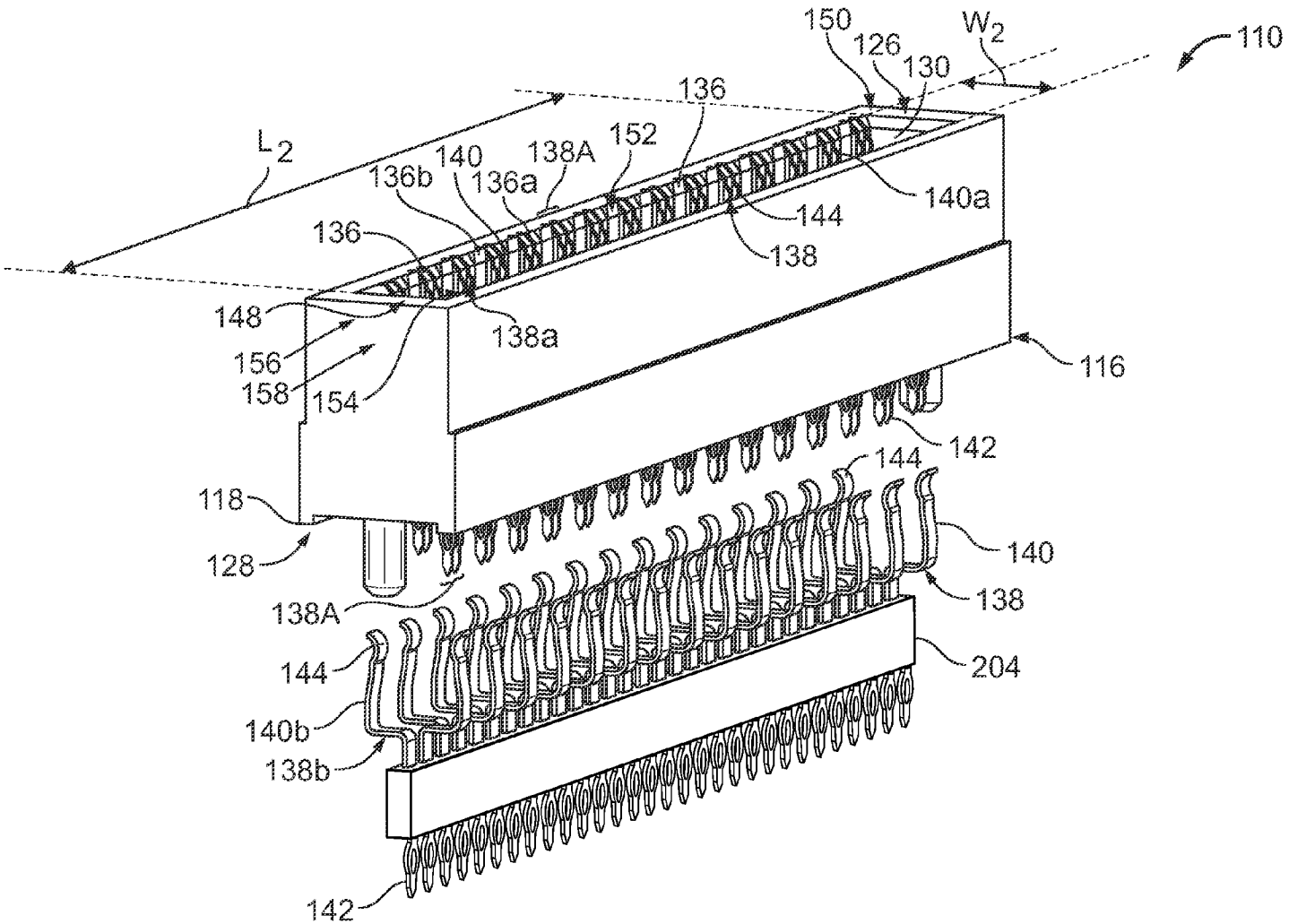
FIG. 7 is a partially exploded perspective view of an exemplary alternative embodiment of a card edge connector.

FIG. 7 is a partially exploded perspective view of an exemplary alternative embodiment of a card edge connector 110. The connector 110 includes a housing 116 having a dielectric body 118. The housing 116 includes a mating side 126 and a mounting side 128. The body 118 includes a card slot 130 that is configured to receive a card edge 132 (FIG. 9) of an electronic module 114 (FIG. 9) therein. The housing body 118 includes a plurality of openings 136 that hold electrical contacts 138 therein. The electrical contacts 138 include mating segments 140 and mounting segments 142. The connector 110 may include any number of the electrical contacts 138. A combination of the connector 110 and the electronic module 114 may be referred to herein as an "electrical connector assembly".

The card slot 130 extends a length $L_2$ from an end 148 to an opposite end 150. The card slot 130 extends a width $W_2$ from a side 152 to an opposite side 154. The card slot 130 is elongate. The mating segments 140 of the electrical contacts 138 are arranged in a pair of opposing rows 156 and 158 that extend along the sides 152 and 154, respectively, of the card slot 130. Mating interfaces 144 of the electrical contacts 138 within the row 156 face generally towards, or oppose, the mating interfaces 144 of the electrical contacts 138 within the opposing row 158, and vice versa. The length $L_2$ of the card slot 130 may be referred to herein as a "slot length". Each of the sides 152 and 154 of the card slot 130 may be referred to herein as a "first side" and/or a "second side". The rows 156 and 158 may each be referred to herein as a "first row" and/or a "second row".

The electrical contacts 138 include signal contacts 138*a* and ground contacts 138*b*. Mating segments 140*a* of the signal contacts 138*a* are held within signal openings 136*a* of the housing openings 136. Mating segments 140*b* of the ground contacts 138*b* are held within ground openings 136*b* of the housing openings 136. The electrical contacts 138 optionally include one or more power contacts that are configured to carry electrical power. The signal contacts 138*a* are arranged in differential signal pairs 138A. In the exemplary embodiment, the mating segments 140*a* of adjacent signal contacts 138*a* within the row 156 are arranged in differential signal pairs 138A, and the mating segments 140*a* of adjacent signal contacts 138*a* within the row 158 are arranged in differential signal pairs 138A. In some alternative embodiments, one or more of the signal contacts 138*a* is not arranged in a differential signal pair. Moreover, in some alternative embodiments, the mating segment 140*a* of a signal contact 138*a* within the row 156 is arranged in a differential signal pair with the mating segment 140*a* of a signal contact 138*a* within the row 158. In the exemplary embodiment, the mating segments 140*a* of differential pairs 138A within the rows 156 and 158 are staggered relative to each other along the length of the housing body 118. Alternatively, the mating segments 140*a* of differential pairs 138A within the row 156 are transversely aligned with the mating segments 140*a* of corresponding differential pairs 138A within the row 158 along the length of the housing body 118.

The mating segments 140*b* of the ground contacts 138*b* are arranged within the rows 156 and 158 between adjacent differential signal pairs 138A. In the exemplary embodiment, a single mating segment 140*b* of the ground contacts 138*b* extends between each pair of adjacent differential signal pairs 138A within each of the rows 156 and 158. But, any number of mating segments 140*b* of the ground contacts 138*b* may extend between adjacent differential signal pairs 138A. Each of the mating segments 140*b* of the ground contacts 138*b* may be referred to herein as a "ground mating segment".

The signal contacts 138*a* of the connector 110 are held directly by the housing body 118 in a manner that is similar to how the signal contacts 38*a* (FIGS. 1-4) are held directly by the housing 16 (FIGS. 1-6), for example as shown in FIG. 4. But, the ground contacts 138*b* are indirectly held by the housing body 118. Specifically, the ground contacts 138*b* are held by a dielectric insert 204 that is held by the housing body 118. The ground contacts 138*b* include bases 192 (FIG. 9) that are held by the insert 204. Optionally, the bases 192 of the ground contacts 138*b* are mechanically connected to adjacent ground contacts 138*b* via an electrically conductive segment (not shown), such that adjacent ground contacts 138*b* are electrically connected together. For example, in some embodiments the ground contacts 138*b* are stamped from a sheet of material and a carrier (not shown) that initially connects adjacent ground contacts 138*b* together after the stamping process is allowed to remain in place instead of being broken to separate adjacent ground contacts 138*b*. The electrical connection between adjacent ground contacts 138*b* provided by the electrically conductive segment electrically shorts the ground contacts 138*b* with each other. The housing 116 may be considered to include both the housing body 118 and the insert 204. The bases 192 may be referred to herein as "ground bases".

The insert 204 may be fabricated using any suitable process, method, and/or the like. Moreover, the ground contacts 138*b* may each be held by the insert 204 using any suitable manner, configuration, structure, means, method, process, and/or the like. In the exemplary embodiment, the insert 204 is molded over the bases 192 of the ground contacts 138*b* using any suitable molding process, method, and/or the like. In some alternative embodiments, the insert 204 is fabricated separately from the ground contacts 138*b* (using any suitable process, method, and/or the like) and the ground contacts 138*b* are thereafter inserted into cavities (not shown) provided within the insert 204.

Figure 8:
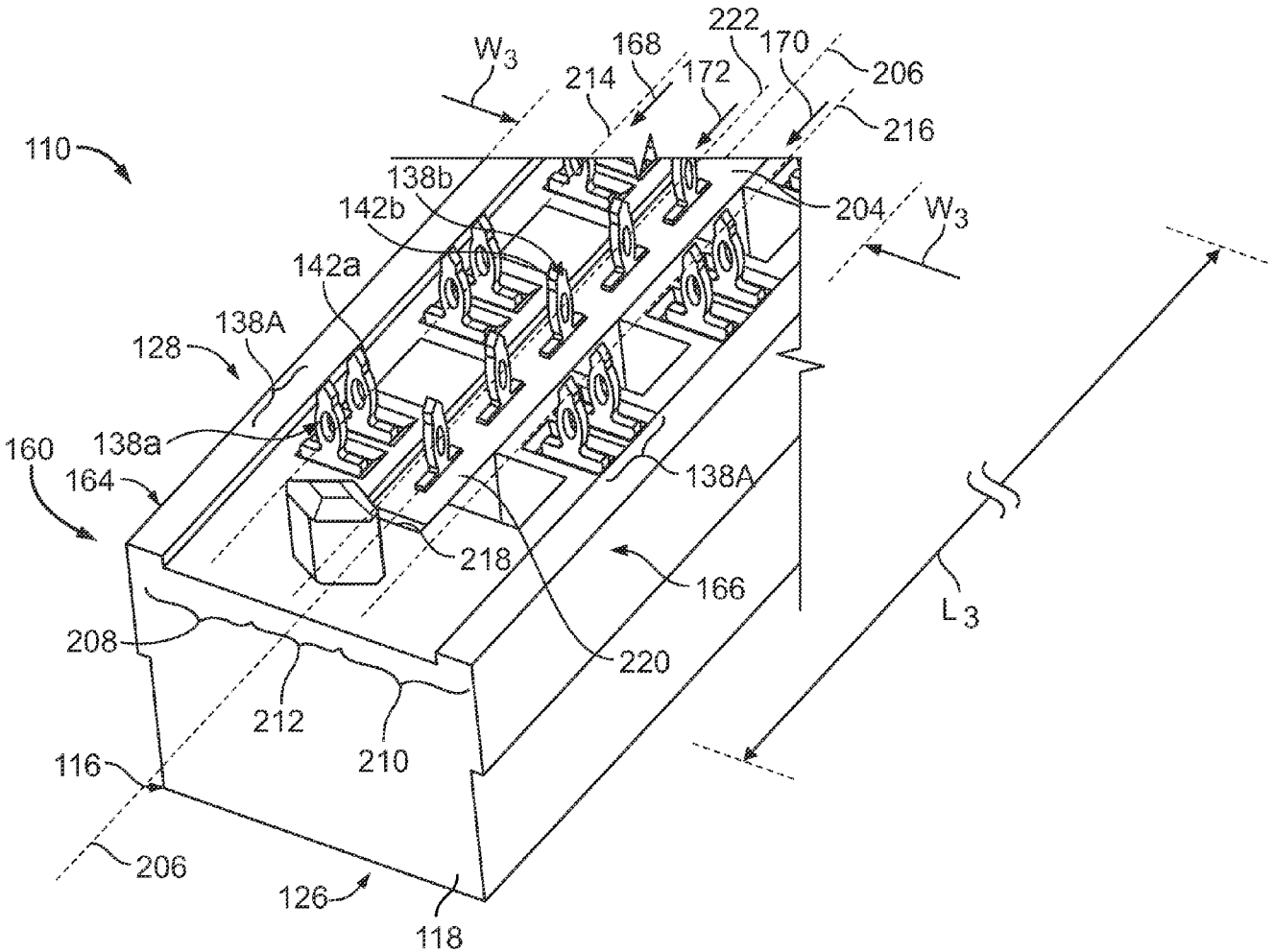
FIG. 8 is a perspective view of a portion of the card edge connector shown in FIG. 7.
Figure 9:
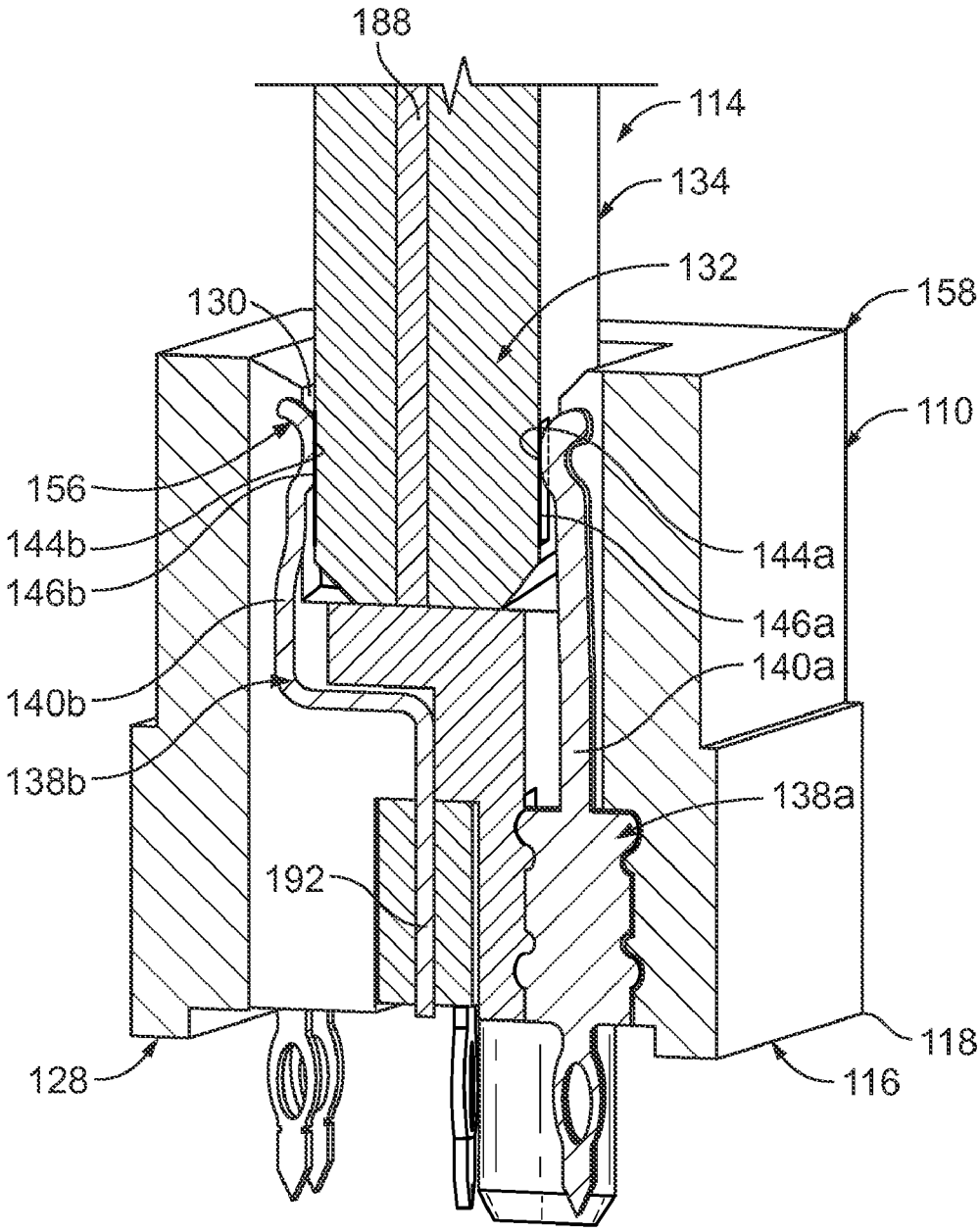
FIG. 9 is a cross-sectional view of the card edge connector shown in FIG. 7 illustrating an exemplary embodiment of an electronic module mated therewith.

FIG. 8 is a perspective view of a portion of the card edge connector 110 illustrating the mounting side 128 of the housing 116. The mounting side 128 extends a length $L_3$ along a central longitudinal axis 206 from an end 160 to an opposite end (not shown). Only a portion of the length $L_3$ of the mounting side 128 is shown in FIG. 8. The mounting side 128 extends a width $W_3$ from a side 164 to an opposite side 166. The length $L_3$ of the mounting side 128 extends in a direction that extends along the direction of the length $L_2$ (FIG. 7) of the card slot 130 (FIGS. 7 and 9). For example, in the exemplary embodiment the length $L_3$ of the mounting side 128 extends in a direction that is approximately parallel to the direction of the length $L_2$ of the card slot 130. The length $L_3$ of the mounting side 128 may be referred to herein as a "side length".

The mounting side 128 includes side segments 208 and 210 that extend along the length $L_3$ of the mounting side 128. A central segment 212 of the mounting side 128 extends between the side segments 208 and 210 along the length $L_3$ of the mounting side 128. In other words, the central segment 212 spaces apart and interconnects the sides segments 208 and 210 along the width $W_3$ of the mounting side 128. Each of the side segments 208 and 210 may be referred herein as a "first side segment" and/or a "second side segment".

Mounting segments 142*a* of the signal contacts 138*a* are arranged in a pair of rows 168 and 170 that extend along the length $L_3$ of the mounting side 128. The rows 168 and 170 extend along respective row axes 214 and 216. More particularly, the rows 168 and 170 extend in directions that are approximately parallel to the direction of the length $L_3$ of the mounting side 128. The rows 168 and 170 are spaced apart from each other along the width $W_3$ of the mounting side 128. For example, the row axes 214 and 216 of the rows 168 and 170, respectively, are spaced apart from each other along the width $W_3$ of the mounting side 128. As can be seen in FIG. 8, the row 168 extends along the side segment 208 of the mounting side 128, while the row 170 extends along the side segment 210. Optionally, the rows 168 and/or 170 extend approximately parallel to the length $L_2$ of the card slot 130. The rows 168 and 170 may each be referred to herein as a "first signal row" and/or a "second signal row". The row axes 214 and 216 may each be referred to herein as a "first signal row axis" and/or a "second signal row axis".

In the exemplary embodiment, the mounting segments 142*a* of adjacent signal contacts 138*a* within the row 168 are arranged in the differential signal pairs 138A, and the mounting segments 142*a* of adjacent signal contacts 138*a* within the row 170 are arranged in the differential signal pairs 138A. In some alternative embodiments, the mounting segment 142*a* of a signal contact 138*a* within the row 168 is arranged in a differential signal pair with the mounting segment 142*a* of a signal contact 138*a* within the row 170. In the exemplary embodiment, the mounting segments 142*a* of differential pairs 138A within the rows 168 and 170 are staggered relative to each other along the length $L_3$ of the mounting side 128. Alternatively, the mounting segments 142*a* of differential pairs 138A within the row 168 are transversely aligned with the mounting segments 142*a* of corresponding differential pairs 138A within the row 170 along the length $L_3$ of the mounting side 128.

The housing body 118 includes an opening 218 that extends between the rows 168 and 170 of the mounting segments 142*a* of the signal contacts 138*a*. The opening 218 fluidly communicates with the ground openings 136*b* (FIG. 7) that extend along the mating side 126 of the housing 116. The insert 204 is held within the opening 218 such that the mating segments 140*b* of the ground contacts 138*b* extend within corresponding ground openings 136*b* (FIG. 7). The insert 204 may be held within the opening 218 using any suitable structure, means, arrangement, and/or the like, such as, but not limited to, using an interference-fit arrangement, using a snap-fit arrangement, using a latch, and/or the like. As can be seen in FIG. 8, a surface 220 of the insert 204 defines a portion of the mounting side 128, and more particularly defines a portion of the central segment 212 of the mounting side 128.

When the insert 204 is held by the housing 116 as shown in FIG. 8, mounting segments 142*b* of the ground contacts 138*b* are arranged in a row 172 that extends along the length $L_3$ of the of the mounting side 128. More particularly, the row 172 extends in a direction that is approximately parallel to the direction of the length $L_3$ of the mounting side 128. The row 172 extends along a row axis 222. The row 172 extends between the rows 168 and 170 of the signal contact mounting segments 142*a* along the width $W_3$ of the mounting side 128. For example, as can be seen in FIG. 8, the row 172 extends along the central segment 212 of the mounting side 128. The row axis 222 of the row 172 is offset along the width $W_3$ of the mounting side 128 from each of the row axes 214 and 216 of the respective rows 168 and 172 such that the row axis 222 extends between the row axes 214 and 216 along the width $W_3$ of the mounting side 128. As shown in FIG. 8, the row axis 222 of the row 172 is optionally aligned with the central longitudinal axis 206 along the width $W_3$ of the mounting side 128. The row 172 of the ground contact mounting segments 142*b* optionally extends approximately parallel to the length $L_2$ of the card slot 130. Optionally, the mounting segments 142*b* of the ground contacts 138*b* are oriented approximately perpendicular to the mounting segments 142*a* of the signal contacts 138*a*. As can be seen in FIG. 8, no mounting segments 142*b* of the ground contacts 138*b* extend within the row 168 or the row 170 of signal contact mounting segments 142*a*, and vice versa.

The mounting segments 142*b* of the ground contacts 138*b* may be referred to herein as "ground mounting segments". The row 172 may be referred to herein as a "ground row", and the row axis 222 may be referred to herein as a "ground row axis". Each of the mating segments 140*a* of the signal contacts 138*a* may be referred to herein as a "signal mating segment". The signal contacts 138*a* having mating segments 140*a* arranged within the row 156 may be referred to herein as "first signal contacts" and/or "second signal contacts", while the signal contacts 138*a* having mating segments 140*a* arranged within the row 158 may be referred to herein as "first signal contacts" and/or "second signal contacts". The differential signal pairs 138A of the signal contacts 138*a* within the row 156 and the differential signal pairs 138A of the signal contacts 138*a* within the row 158 may each be referred to herein as "first differential signal pairs" and/or "second differential signal pairs". The mounting segments 142*a* arranged within the row 168 may be referred to herein as "first signal mounting segments" and/or "second signal mounting segments", while the mounting segments 142*a* arranged within the row 170 may be referred to herein as "first signal mounting segments" and/or "second signal mounting segments".

FIG. 9 is a cross-sectional view of the card edge connector 110 illustrating an exemplary embodiment of an electronic module 114 mated therewith. When the electronic module 114 is mated with the connector 110, a card edge 132 of a printed circuit board (PCB) 134 of the electronic module 114 is received within the card slot 130 of the connector 110. Mating interfaces 144*b* of the mating segments 140*b* of the ground contacts 138*b* are engaged with ground contact pads 146*b* the card edge 132 to electrically connect the ground contacts 138*b* to a ground plane 188 of the PCB 134. Mating interfaces 144*a* of the mating segments 140*a* of the signal contacts 138*a* are engaged with signal contact pads 146*a* on the card edge 132 to electrically connect the signal contacts 138*a* to the PCB 134.

As should be apparent from FIG. 9, when the electronic module 114 is mated with the connector 110, the ground plane 188 extends between the opposing rows 156 and 158 of the mating segments 140 of the electrical contacts 138. Along the width $W_2$ (FIG. 7) of the card slot 130 (FIGS. 7 and 9), the ground plane 188 extends between the differential signal pairs 138A (FIGS. 7 and 8) that are arranged within the row 156 and the differential signal pairs 138A that are arranged within the row 158. The ground plane 188 thus electrically isolates the differential signal pairs 138A within the row 156 from the differential signal pairs 138A within the row 158. The impedance of the connector 110 can be tuned to facilitate achieving a predetermined impedance by selecting the pitch between adjacent signal contacts 138*a* and/or between adjacent differential signal pairs 138A, by selecting the number and/or spacing of the ground contacts 138*b* relative to each other and/or signal contacts 138*a*, by selecting the amount of air and/or dielectric materials of the housing body 118 that extend between signal contacts 138*a* and/or between a signal contact 138*a* and a ground contact 138*b*, and/or the like.

Figure 10:
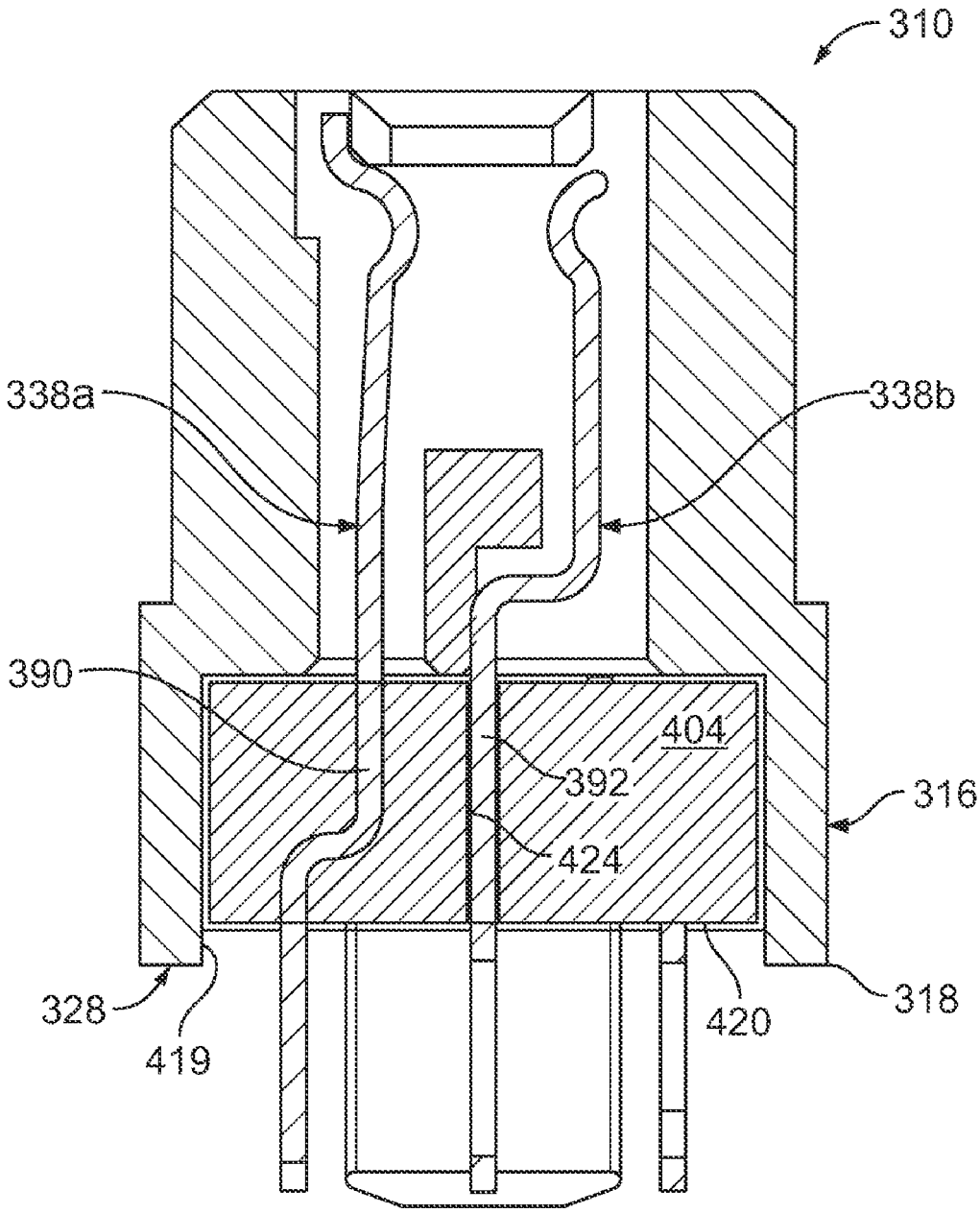
FIG. 10 is a cross-sectional view of another exemplary alternative embodiment of a card edge connector.

FIG. 10 is a cross-sectional view of another exemplary alternative embodiment of a card edge connector 310. The connector 310 includes a housing 316 having a dielectric body 318. The housing 316 includes a mounting side 328. The housing body 318 includes an opening 419 for receiving a dielectric insert 404 that holds signal contacts 338*a* and ground contacts 338*b*. Optionally, the connector 310 includes one or more power contacts that are configured to carry electrical power. The signal and ground contacts 338*a* and 338*b*, respectively, include respective bases 390 and 392. The connector 310 may include any number of signal contacts 338*a*, any number of ground contacts 338*b*, and any number of power contacts. The housing 316 may be considered to include both the housing body 318 and the insert 404.

Both the signal contacts 338*a* and the ground contacts 338*b* are indirectly held by the housing body 318. More particularly, the signal and ground contacts 338*a* and 338*b*, respectively, are held by the dielectric insert 404, which is held by the housing body 318 within the opening 419. The insert 404 may be held within the opening 419 using any suitable structure, means, arrangement, and/or the like, such as, but not limited to, using an interference-fit arrangement, using a snap-fit arrangement, using a latch, and/or the like. A surface 420 of the insert 404 defines a portion of the mounting side 328 of the housing 316.

The insert 404 may be fabricated using any suitable process, method, and/or the like. Moreover, the signal contacts 338*a* and the ground contacts 338*b* may each be held by the insert 404 using any suitable manner, configuration, structure, means, method, process, and/or the like. In the exemplary embodiment, the insert 404 is molded over the bases 390 of the signal contacts 338*a* (using any suitable molding process, method, and/or the like) and the bases 392 of the ground contacts 338*b* are inserted into one or more cavities 424 of the insert 404 after the insert 404 has been molded over the signal contacts 338*a*. The bases 392 of the ground contacts 338*b* may be held within the cavities 424 using any suitable structure, means, arrangement, and/or the like, such as, but not limited to, using an interference-fit arrangement, using a snap-fit arrangement, using a latch, and/or the like.

In some alternative embodiments, the insert 404 is molded over the bases 392 of the ground contacts 338*b* (using any suitable molding process, method, and/or the like) and the bases 390 of the signal contacts 338*a* are inserted into one or more cavities of the insert 404 after the insert 404 has been molded over the ground contacts 338*b*. In other alternative embodiments, the insert 404 is molded (using any suitable molding process, method, and/or the like) over both the signal and ground contacts 338*a* and 338*b*, respectively. In still other alternative embodiments, the bases 390 and 392 of the both the signal contacts 338*a* and the ground contacts 338*b*, respectively, are inserted into one or more cavities of the insert 404 after the insert 404 has been fabricated.

Optionally, the bases 392 of the ground contacts 338*b* are mechanically connected to the bases 392 of adjacent ground contacts 338*b* via an electrically conductive segment (not shown), such that adjacent ground contacts 338*b* are electrically connected together. The electrical connection between adjacent ground contacts 338*b* provided by the electrically conductive segment electrically shorts the ground contacts 338*b* with each other.

A combination of the connector 310 and an electronic module may be referred to herein as an "electrical connector assembly". Each of the signal contacts 338*a* may be referred to herein as a "first signal contact" and/or a "second signal contact". The bases 390 may be referred to herein as "signal bases", while the bases 392 may be referred to herein as "ground bases".

Figure 11:
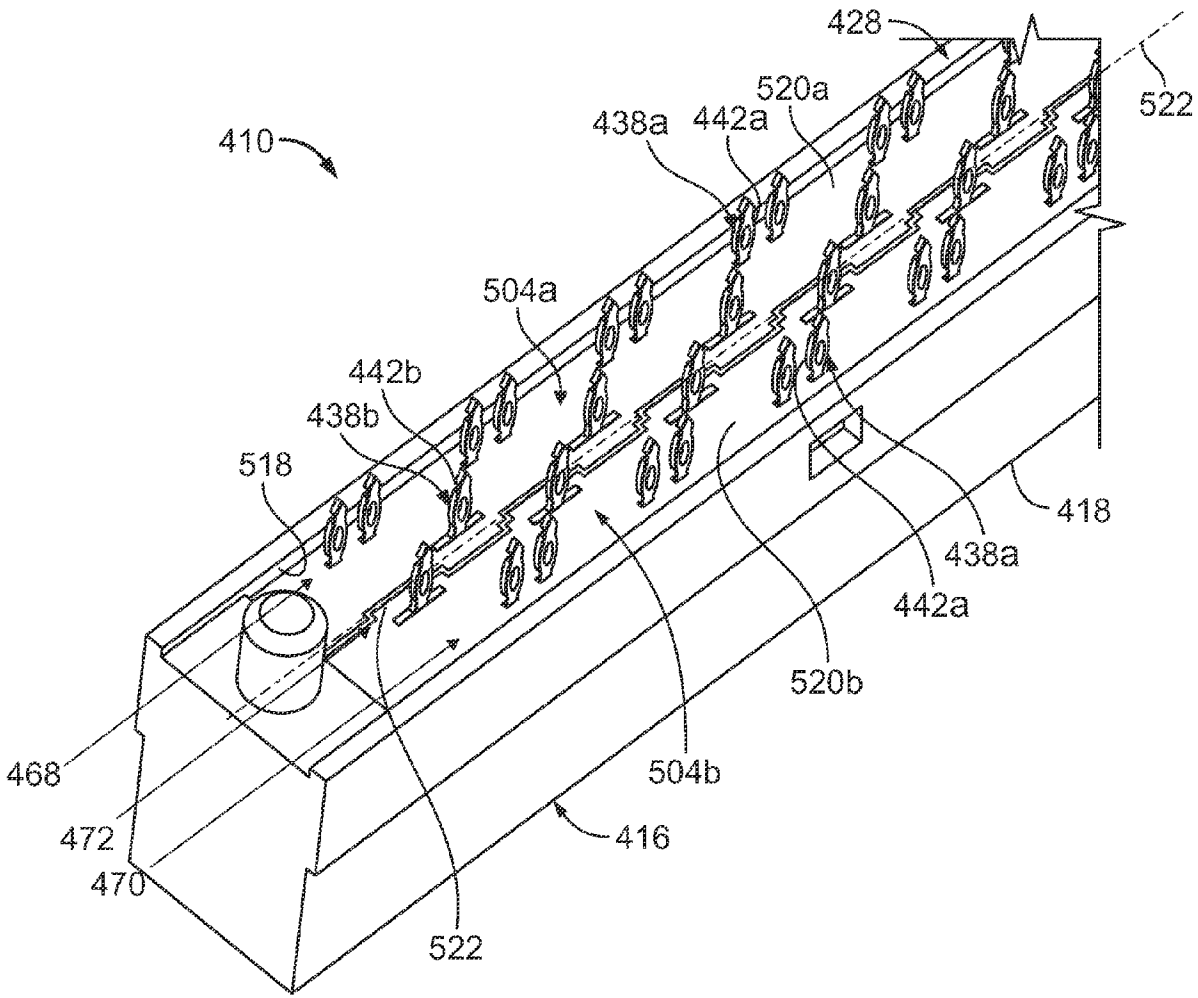
FIG. 11 is a perspective view of a portion of another exemplary alternative embodiment of a card edge connector.

FIG. 11 is a perspective view of a portion of yet another exemplary alternative embodiment of a card edge connector 410. The connector 410 includes a housing 416 having a dielectric body 418. The housing 416 includes a mounting side 428. The housing body 418 includes an opening 518 for receiving dielectric inserts 504*a* and 504*b* that each hold signal contacts 438*a* and ground contacts 438*b*. The inserts 504*a* and 504*b* may each be held within the opening 518 using any suitable structure, means, arrangement, and/or the like, such as, but not limited to, using an interference-fit arrangement, using a snap-fit arrangement, using a latch, and/or the like. Surfaces 520*a* and 520*b* of the inserts 504*a* and 504*b*, respectively, define a portion of the mounting side 428 of the housing 416. The housing 416 may be considered to include the housing body 418 and the inserts 504*a* and 504*b*. The connector 410 optionally includes one or more power contacts that are configured to carry electrical power. The connector 410 may include any number of signal contacts 438*a*, any number of ground contacts 438*b*, and any number of power contacts.

The signal and ground contacts 438*a* and 438*b*, respectively, include respective mounting segments 442*a* and 442*b*. The mounting segments 442*a* and 442*b* of the signal and ground contacts 438*a* and 438*b*, respectively, extend along the mounting side 428. The insert 504*a* holds a row 468 of the mounting segments 442*a* of the signal contacts 338*a*, and the insert 504*b* holds another row 470 of the mounting segments 442*a* of the signal contacts 338*a*. The mounting segments 442*b* of the ground contacts 338*b* are arranged in a row 472 that extends along a length of the mounting side 428. More particularly, the row 472 extends in a direction that is approximately parallel to the direction of the length of the mounting side 428. The row 472 extends along a row axis 522. As can be seen in FIG. 11, adjacent mounting segments 442*b* within the row 472 are staggered on respective opposite sides of the row axis 522. The insert 504*a* holds the mounting segments 442*b* that extend on one side of the row axis 522, while the insert 504*b* holds the mounting segments 442*b* that extend on the other side of the row axis 522. Optionally, the inserts 504*a* and 504*b* have a substantially similar geometry such that the inserts 504*a* and 504*b* are interchangeable with each other.

The inserts 504*a* and 504*b* may each be fabricated using any suitable process, method, and/or the like. Moreover, the signal contacts 438*a* and the ground contacts 438*b* may each be held by the inserts 504*a* and 504*b* using any suitable manner, configuration, structure, means, method, process, and/or the like. Optionally, the ground contacts 438*b* held by the insert 504*a* and/or the ground contacts held by the insert 504*b* are mechanically connected to adjacent ground contacts 438*b* of the same insert 504*a* or 504*b* via an electrically conductive segment (not shown). The electrical connection between ground contacts 438*b* provided by the electrically conductive segment electrically shorts the ground contacts 438*b* within each insert 504*a* and 504*b* to each other.

A combination of the connector 410 and an electronic module may be referred to herein as an "electrical connector assembly". Each of the signal contacts 438*a* may be referred to herein as a "first signal contact" and/or a "second signal contact". The mounting segments 442*a* of the signal contacts 438*a* may be referred to herein as "first signal mounting segments" and/or "second signal mounting segments". The rows 468 and 470 may each be referred to herein as a "first signal row" and/or a "second signal row". Each of the mounting segments 442*b* of the ground contacts 438*b* may be referred to herein as a "ground mounting segment". The row 472 may be referred to herein as a "ground row", while the row axis 522 may be referred to herein as a "ground row axis".

The embodiments described and/or illustrated herein may provide an electrical connector that has an improved impedance and/or efficiency of data transfer through the connector as compared to at least some known electrical connectors. The embodiments described and/or illustrated herein may provide an electrical connector having a reduced amount of crosstalk, interference, noise, and/or the like, and/or an improved signal performance, than at least some known electrical connectors.

It is to be understood that the above description and the figures are intended to be illustrative, and not restrictive. For example, the above-described and/or illustrated embodiments (and/or aspects thereof) may be used in combination with each other. In addition, many modifications may be made to adapt a particular situation or material to the teachings of the subject matter described and/or illustrated herein without departing from its scope. Dimensions, types of materials, orientations of the various components (including the terms "upper", "lower", "vertical", and "lateral"), and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description and the figures. The scope of the subject matter described and/or illustrated herein should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A card edge connector for mating with a printed circuit board (PCB) having a card edge, the connector comprising:

a housing comprising an elongate card slot and a mounting side, the card slot extending a slot length and being configured to receive the card edge of the PCB therein, the mounting side extending a side length and a width, the side length of the mounting side extending in a direction that extends along a direction of the slot length of the card slot;

signal contacts held by the housing, the signal contacts comprising first signal contacts and second signal contacts, the first and second signal contacts having respective first and second signal mounting segments that are arranged in first and second signal rows, respectively, that extend along the side length of the mounting side of the housing, the first and second signal rows being spaced apart from each other along the width of the mounting side; and ground contacts held by the housing, the ground contacts comprising ground mounting segments arranged in a ground row that extends along the side length of the mounting side, the ground mounting segments being oriented approximately perpendicular to the first and second signal mounting segments, wherein the ground row extends between the first and second signal rows along the width of the mounting side of the housing.

2. The connector of claim 1, wherein the first and second signal rows of the first and second signal mounting segments, respectively, extend along respective first and second signal row axes that are spaced apart along the width of the mounting side of the housing, the ground row of the ground mounting segments extending along a ground row axis, wherein the ground row axis is offset along the width of the mounting side from each of the first and second signal row axes such that the ground row axis extends between the first and second signal row axes along the width of the mounting side.

3. The connector of claim 1, wherein the mounting side of the housing comprises opposite first and second side segments and a central segment that spaces apart and interconnects the first and second side segments along the width of the mounting side, the first and second signal rows of the respective first and second signal mounting segments extending along the first and second side segments, respectively, of the mounting side, wherein the ground row of the ground mounting segments extends along the central segment of the mounting side.

4. The connector of claim 1, wherein the mounting side of the housing extends the side length along a central longitudinal axis, the ground row of the ground mounting segments extending along a row axis that is aligned with the central longitudinal axis of the mounting side along the width of the mounting side.

5. The connector of claim 1, wherein the housing comprises an opening, the first and second signal contacts comprising signal bases that are held by a dielectric insert, the insert being held within the opening of the housing, the insert comprising cavities, the ground contacts comprising ground bases that are held within corresponding cavities, wherein a surface of the insert defines a portion of the mounting side of the housing.

6. The connector of claim 1, wherein the ground contacts are electrically shorted with each other.

7. The connector of claim 1, wherein the ground row of the ground mounting segments extends along a row axis, adjacent ground mounting segments within the ground row being staggered on opposite sides of the row axis.

8. The connector of claim 1, wherein at least one of:

the direction of the side length of the mounting side extends approximately parallel to the direction of the slot length of the card slot;

the first and second signal rows extend approximately parallel to at least one of the side length of the mounting side or the slot length of the card slot; or the ground row extends approximately parallel to the slot length of the card slot.

9. The connector of claim 1, wherein the first signal contacts are arranged in first differential signal pairs and the second signal contacts are arranged in second differential signal pairs, at least one of the ground mounting segments extending between adjacent first differential signal pairs in the first signal row along the side length of the mounting side.

10. The connector of claim 1, wherein the first signal contacts are arranged in first differential signal pairs and the second signal contacts are arranged in second differential signal pairs, and wherein at least one of the ground mounting segments extends between adjacent second differential signal pairs in the second signal row along the side length of the mounting side.

11. A card edge connector for mating with a printed circuit board (PCB) having a card edge, the connector comprising:

a housing comprising an elongate card slot and a mounting side, the card slot extending a slot length and being configured to receive the card edge of the PCB therein, the mounting side extending a side length and a width, the side length of the mounting side extending in a direction that extends along a direction of the slot length of the card slot;

signal contacts held by the housing, the signal contacts comprising first signal contacts and second signal contacts, the first and second signal contacts having respective first and second signal mounting segments that are arranged in first and second signal rows, respectively, that extend along the side length of the mounting side of the housing, the first and second signal rows being spaced apart from each other along the width of the mounting side; and ground contacts held by the housing, the ground contacts comprising ground mounting segments arranged in a ground row that extends along the side length of the mounting side, wherein the ground row extends between the first and second signal rows along the width of the mounting side of the housing, wherein the housing comprises an opening extending between the first and second signal rows of the respective first and second signal mounting segments, the ground contacts comprising bases that are held by a dielectric insert, the insert being held within the opening of the housing, wherein a surface of the insert defines a portion of the mounting side of the housing.

12. A card edge connector for mating with a printed circuit board (PCB) having a card edge, the connector comprising:

a housing comprising an elongate card slot and a mounting side, the card slot extending a slot length and being configured to receive the card edge of the PCB therein, the mounting side extending a side length and a width, the side length of the mounting side extending in a direction that extends along a direction of the slot length of the card slot;

signal contacts held by the housing, the signal contacts comprising first signal contacts and second signal contacts, the first and second signal contacts having respective first and second signal mounting segments that are arranged in first and second signal rows, respectively, that extend along the side length of the mounting side of the housing, the first and second signal rows being spaced apart from each other along the width of the mounting side, wherein the first signal contacts are arranged in first differential signal pairs and the second signal contacts are arranged in second differential signal pairs, the first differential signal pairs being staggered relative to the second differential signal pairs along the length of the mounting side of the housing; and ground contacts held by the housing, the ground contacts comprising ground mounting segments arranged in a ground row that extends along the side length of the mounting side, wherein the ground row extends between the first and second signal rows along the width of the mounting side of the housing.

13. An electrical connector assembly comprising:

a printed circuit board (PCB) comprising a card edge; and a card edge connector comprising:

a housing comprising an elongate card slot and a mounting side, the card slot extending a slot length and receiving the card edge of the PCB therein, the mounting side extending a side length and a width, the side length of the mounting side extending in a direction that extends along a direction of the slot length of the card slot, the housing comprising an opening;

signal contacts held by the housing, the signal contacts comprising first signal contacts and second signal contacts, the first and second signal contacts having respective first and second signal mounting segments that are arranged in first and second signal rows, respectively, that extend along the side length of the mounting side of the housing, the first and second signal rows being spaced apart from each other along the width of the mounting side, the first and second signal contacts comprising signal bases that are held by a dielectric insert, the insert being held within the opening of the housing, the insert comprising cavities; and ground contacts held by the housing, the ground contacts comprising ground mounting segments arranged in a ground row that extends along the side length of the mounting side, wherein the ground row extends between the first and second signal rows along the width of the mounting side of the housing, the ground contacts comprising ground bases that are held within corresponding cavities, wherein a surface of the insert defines a portion of the mounting side of the housing.

14. The assembly of claim 13, wherein the first and second signal rows of the first and second signal mounting segments, respectively, extend along respective first and second signal row axes that are spaced apart along the width of the mounting side of the housing, the ground row of the ground mounting segments extending along a ground row axis, wherein the ground row axis is offset along the width of the mounting side from each of the first and second signal row axes such that the ground row axis extends between the first and second signal row axes along the width of the mounting side.

15. The assembly of claim 13, wherein the mounting side of the housing comprises opposite first and second side segments and a central segment that spaces apart and interconnects the first and second side segments along the width of the mounting side, the first and second signal rows of the respective first and second signal mounting segments extending along the first and second side segments, respectively, of the mounting side, wherein the ground row of the ground mounting segments extends along the central segment of the mounting side.

16. The assembly of claim 13, wherein the mounting side of the housing extends the side length along a central longitudinal axis, the ground row of the ground mounting segments extending along a row axis that is aligned with the central longitudinal axis of the mounting side along the width of the mounting side.

17. The assembly of claim 13, wherein the ground contacts are electrically shorted with each other.

18. The assembly of claim 13, wherein the first signal contacts are arranged in first differential signal pairs and the second signal contacts are arranged in second differential signal pairs, the first differential signal pairs being staggered relative to the second differential signal pairs along the length of the mounting side of the housing.

19. The assembly of claim 13, wherein the ground row of the ground mounting segments extends along a row axis, adjacent ground mounting segments within the ground row being staggered on opposite sides of the row axis.

20. The assembly of claim 13, wherein at least one of:

the direction of the side length of the mounting side extends approximately parallel to the direction of the slot length of the card slot;

the first and second signal rows extend approximately parallel to at least one of the side length of the mounting side or the slot length of the card slot; or the ground row extends approximately parallel to the slot length of the card slot.

* * * * *